US005507050A

United States Patent [19]

Welner

[11] Patent Number: 5,507,050

[45] Date of Patent: Apr. 16, 1996

[54] EXAMINATION TABLE

[76] Inventor: Sandra L. Welner, 8484 16th St., Apt. 707, Silver Spring, Md. 20910

[21] Appl. No.: 233,825

[22] Filed: Apr. 26, 1994

[51] Int. Cl.[6] ..... A61G 13/00

[52] U.S. Cl. ..... 5/600; 5/611; 5/624

[58] Field of Search ..... 5/600, 602, 611, 5/623, 624, 648–651, 427, 428

[56] References Cited

U.S. PATENT DOCUMENTS

| | | | |
|---|---|---|---|
| 548,024 | 10/1895 | Adams . | |
| 1,607,168 | 11/1926 | Murphy . | |
| 2,057,992 | 10/1936 | Wiruth . | |
| 2,067,891 | 1/1937 | Comper . | |
| 2,605,152 | 7/1952 | Krewson . | |
| 2,757,058 | 7/1956 | Broesel . | |
| 2,804,363 | 8/1957 | Spielberg . | |
| 3,080,577 | 3/1963 | Atkinson | 5/428 |
| 3,227,440 | 1/1966 | Scott . | |
| 3,289,674 | 12/1966 | Platt . | |
| 3,334,951 | 8/1967 | Douglas, Jr. et al. | 5/624 X |
| 3,452,978 | 7/1969 | Creelman . | |
| 3,612,509 | 10/1971 | Boston | 5/600 X |
| 3,861,666 | 1/1975 | Nishiyama et al. . | |
| 3,933,154 | 1/1976 | Cabansag . | |
| 3,944,205 | 3/1976 | Mueller . | |
| 4,186,456 | 2/1980 | Huempfner | 5/428 |
| 4,186,738 | 2/1980 | Schleicher et al. . | |
| 4,225,127 | 9/1980 | Strutton | 5/624 X |
| 4,564,164 | 8/1984 | Allen et al. | 5/624 X |
| 4,698,837 | 10/1987 | Van Steenburg . | |
| 4,809,687 | 3/1989 | Allen . | |
| 4,886,258 | 12/1989 | Scott | 5/624 |
| 5,022,105 | 6/1991 | Catoe | 5/611 |
| 5,369,827 | 12/1994 | Parke et al. | 5/649 |

*Primary Examiner*—Michael F. Trettel
*Attorney, Agent, or Firm*—Browdy and Neimark

[57] ABSTRACT

An examination table which can be used for handicapped or injured patients can be lowered enough to permit sliding a wheelchair bound patient directly onto the table without having to lift the patient. The head of the table can be raised or lowered, and the patient's head and upper body can be strapped down to the table where appropriate. Side bars keep the patient on the table when there is a danger that the patient may slide or roll off of the table. Two types of stirrups are provided: conventional stirrups can be moved into any direction to accommodate patients whose legs may move or be locked in different directions from the attitude of conventionally attached stirrups. For patients who require additional leg or foot support or who require support distributed over a large area, stirrups fitted with boots can be used to provide this support. The boots are sufficiently long to provide support at least up to the knee, and preferably up part of the thigh. A conveyor belt is provided to move patients from the head of the table down to the foot.

10 Claims, 2 Drawing Sheets

EXAMINATION TABLE

FIELD OF THE INVENTION

The present invention is directed to an examination table which can be used with handicapped or injured patients.

BACKGROUND OF THE INVENTION

Treating the medical needs of handicapped or injured patients requires somewhat different equipment from that used for conventional patients. For example, if a patient is wheelchair bound, the patient must be lifted onto an examination table from the wheelchair. Since the seat level of the wheelchair is generally about nineteen inches above the ground, and the average examination table can only be lowered to about 26 inches, the patient must be lifted out of the wheelchair onto the examination table. This lifting requires several persons, depending upon the weight and mobility of the wheelchair bound patient.

In addition to requiring means to move from wheelchair to examination table, many handicapped or injured patients have other special needs. For example, where the patient has one leg longer than the other, either due to congenital problems or to amputation, both legs do not conform to the configuration for conventional stirrups. Particularly in the case of single amputees, it is difficult to situate both legs in stirrups for conventional gynecological examinations.

Even when both legs are approximately the same length, some patients experience muscle spasms, which may be aggravated when the patient's feet are placed into stirrups. It is thus important to provide means to retain the patient's legs in place comfortably during the time that the patient is on the examination table. Of particular concern is when dealing with burn patients, whose skin is particularly sensitive to any type of pressure, yet whose muscles may be subject to spasms when immobilized.

Occasionally the patient's muscular spasms are not confined to the legs, so that the entire body must be restrained while the patient is on the table. Although handrails on either side of the table can be used to maintain the patient in position on the table, handrails are often not sufficient to keep the patient in a stable position during a medical examination or procedure.

Unfortunately, the needs of handicapped and injured patients have traditionally been ignored, and, to date no medical examination tables or obstetrical tables have been designed to accommodate patients with a variety of handicaps. None is capable of being adjusted to suit the particular needs of each patient. Although examination tables having a variety of features are presently available, none of these tables has been designed specifically to aid a physician in examining a handicapped or injured patient and to enable the patient to undergo medical examinations or treatment with some degree of comfort.

A number of prior workers have provided examination or obstetrical tables with a variety of features. For example, Murphy, in U.S. Pat. No. 1,607,168, discloses an obstetric table having adjustable shoulder straps and limb holding devices which support the patient's leg from the heel to the knee. However, there is no recognition that the patient's legs may not be the same length.

Broesel, in U.S. Pat. No. 2,757,058, discloses a delivery crutch for obstetrical tables for supporting the mother's legs during delivery. Although this crutch can be adjusted for a variety of leg sizes, there is no provision for adjusting the crutch to accommodate legs that may be incapable of being moved into standard positions for delivery.

Comper, in U.S. Pat. No. 2,067;891, discloses leg supporting means for obstetrical beds which are adjustable to accommodate legs of any size. However, there is no provision for accommodating legs which may not be capable of angular movement in the direction needed for obstetrical procedures.

Wiruth, in U.S. Pat. No. 2,057,992, discloses a leg support and restraining device which firmly secures the entire leg from just above the knee to the foot. The device can be locked against rotation and longitudinal movement. Straps are provided for securely strapping the patient's legs, ankles and feet to the supports.

Allen, in U.S. Pat. No. 4,809,687, discloses a stirrup for supporting a patient's limb in a desired attitude. The stirrup includes a shell lined with a soft material. The shell can be suspended from a support by adjustable straps, and the straps can be adjusted to control the positioning of the limb. Two boot-like attachments of the stirrup can be used to support a patient's legs for gynecological procedures. Unfortunately, in this case the shell is suspended from the support, so that there is insufficient support for a limb that may be spastic or unable to remain in one spot for an extended period of time.

A heel supporting boot or bed patients is shown in Schleicher et al., U.S. Pat. No. 4,186,738.

VELCRO® hook and loop type filamentary engaging fasteners are used to immobilize patients on tables used for X-ray procedures. Cabansag, in U.S. Pat. No. 3,933,154, discloses an immobilizer for use in X-ray and surgical procedures which includes a back which can be rigid or bent in a variety of positions. The immobilizer has a plurality of flexible straps for securing different sections of a patient's body against movement. Means are provided for restraining knees and elbows as well as the head.

Nishiyama et al., in U.S. Pat. No. 3,861,666, disclose a device for fastening a patient to a bed plate, along with engageable support bands.

Unfortunately, to date no one has recognized the special needs of patients with a variety of handicaps or restrictions from injuries, and consequently there has been no provision for examination tables which enable a handicapped person to be examined with a minimum of distress to the patient as well as the requirement for a minimum number of personnel to aid the patient in gaining access to the table.

SUMMARY OF THE INVENTION

It is an object of the present invention to overcome the aforesaid deficiencies of the prior art.

It is another object of the present invention to provide an examination table which can be comfortably used by patients with a variety of handicaps or injuries and which enables the patients to readily gain access to the table with a minimum of assistance.

It is a further object of the present invention to provide an examination table which accommodates patients having limbs of varying length and flexibility.

It is yet another object of the present invention to provide an examination table which includes means for restraining patients experiencing muscle spasms.

It is still another object of the present invention to provide an examination table which can be used for patients with skin that is sensitive to even slight amounts of pressure.

According to the present invention, an examination table is provided which can accommodate patients having a great many different types of handicaps, including single or double amputees, patients having muscle spasms, patients who are wheelchair bound, burn patients, and the like. Of primary importance is that the table is designed so that it can be lowered to approximately nineteen inches above the floor level, so that a person in a wheelchair can merely slide from the seat of the wheelchair onto the table. After the patient has been moved onto the table, the table then can be raised to the proper height for the physician or other medical personnel to conduct a medical examination.

The examination table of the present invention can be used for any type of medical examination of patients, and any required additions to the table to accommodate different types of physical examinations that may be contemplated including armboards, alternative types of leg supports, etc.

Limb supports are provided for both legs and arms if desired. The limb support means of the present invention provides support over a substantial portion of the limb, thereby avoiding pressure points and constriction. In addition, the limb supports permit easy manipulation of the attitude of the limb, making it possible to provide the desired orientation of the limb which is being supported for a variety of medical procedures.

Conventional stirrups are provided for patients who are capable of inserting a foot into a conventional stirrup. These conventional stirrups, however, can be retracted or otherwise moved out of the way when not in use.

For patients who are not comfortable with using conventional stirrups, alternative stirrups are provided. These stirrups comprise a boot-like member into which the patient inserts a leg. The leg is cradled in a boot comprising a shell which may be lined with a soft cushioning material. The shell is shaped to conform to the underside of the limb to be supported.

Optional armboards are provided on each side of the table to support one or both arms during administration of intravenous fluids or applying treatment to the arm. Cushioning material may be provided in the armboards as well.

A number of flexible straps are attached to the examination table at various locations. The flexible straps are adapted to be attached over different parts of a patient's body to ensure complete restraint of bodily parts that must be restrained. Elbow and knee restraints can be provided with means for drawing the straps tight around each limb where required to secure the limb against movement.

The head portion of the table is adjustable to different positions to accommodate patients of different heights or differing requirements for head elevation.

In another embodiment, the table is equipped with a conveyor belt which glides over the top of the table to move a patient from the head of the table to the foot of the table to facilitate placement of patients' feet into the stirrups,

DETAILED DESCRIPTION OF THE INVENTION

Figure 2:
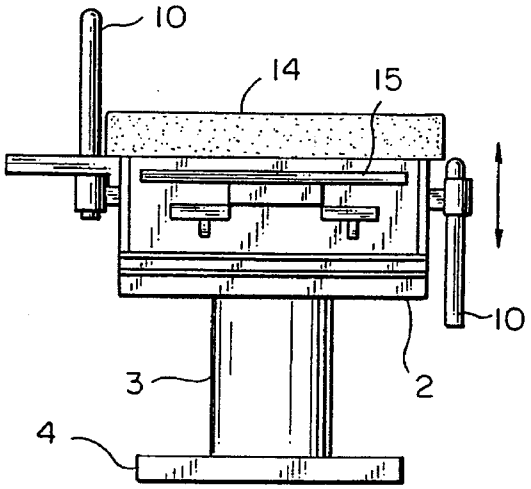
FIG. 2 shows a front view of the examination table of the present invention.

The examination table of the present invention is particularly useful for handicapped or injured patients. Although the table illustrated in the drawings is described as being for gynecological use, the table can be used for all types of medical examinations, depending upon the individual needs of the patient and the types of accessories attached to the table.

Of particular importance is that the table can be lowered to a minimum height of about nineteen inches, which is sufficiently low to permit sliding a wheelchair bound patient directly from the wheelchair onto the table, without the necessity of lifting the patient from the wheelchair. For patients who may be spastic or experience rigidity in one or more limbs, it is particularly useful to avoid the requirement for lifting the patient. Additionally, for injured patients such as burn patients, the patient can be moved onto the table from the wheelchair with a minimum of contact to the patient thus reducing the pressure applied to injured skin. Once the patient is placed onto the table, the table can then be raised to any desired height to accommodate the needs of the examining physician or other medical personnel.

The table 1 comprises a broad base 4 which is approximately the length and width of the top surface of the table. The top of the table, which supports the patient, is connected to the base 4 by telescoping pole 3. When the table is raised or lowered, the telescoping pole 3 telescopes up or down as the height of the table is changed.

The top of the table, the patient support, 2 is made of wood or similar rigid material that can bear an adult patient's weight. This top 2 is generally covered with a cushion 14 which provides padding for the patient. This cushion 14 may be covered with a washable, waterproof material for ease in cleaning.

Because the needs of each patient vary, the table is designed to provide access and comfort for patients with many different types of requirements. Straps 11, which may be fastened with VELCRO® hook and loop type filamentary engaging fasteners, buckles or straps, are positioned at mid-thigh and mid-chest on top of the table. The number of straps provided may vary depending upon the needs of the individual patient; however, at least two straps as illustrated should be provided. Additional straps are located at the top (head) of the table and nearer the bottom of the table if needed.

The straps are attached to the table; each strap has a pair of ends with self attachment means on correspondingly mating sides thereof, such that when the ends are brought into overlapping contact with one another, they will adhere to one another. For example, self attachment means can comprise hook and loop (VELCRO®-type) fasteners. Alternatively, the straps can include a buckle or tying means.

Alternatively, two wide support bands maybe provided on the table to restrain patients in the trunk area. Two support bands have the ends fixed to respective lengthwise edges of the examination table. Optionally, a preliminary fixing strip having its outer surface provided with engagement material and being connected at one end to the fixed end of the support band is provided for initially restraining the patient. When the patient is first placed onto the examination table, she is supported by engagement between the engagement material provided on the inner surface of the first support band and the engagement material provided on the outer surface of the second support band, whereby the patient is securely fixed in place.

Two support rails 10, one on each side of the table, can be raised when needed. The support rails 10 are generally in the down position, as shown in FIG. 2, when a patient is being moved onto the table.

Figure 1:
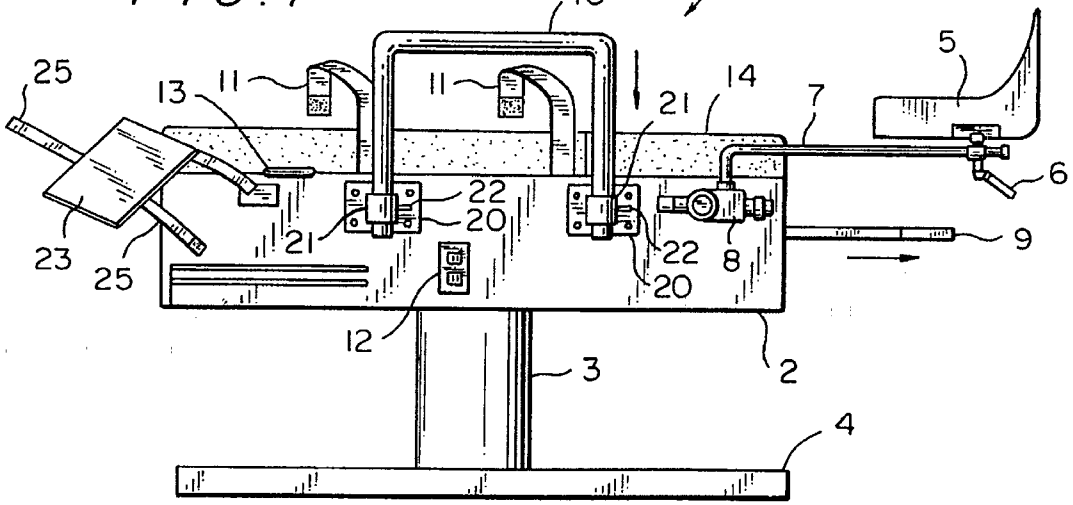
FIG. 1 shows a side view of the examination table of the present invention

The support rails 10 are attached to the table with clamping means such as bolts which are located on both sides of the table 2. These bolts secure clamps 20 with openings into which the rails can fit. Clamping means, such as the lock pins 22 illustrated in FIG. 1, hold the support rails in place. The support rails can be raised or lowered to the desired height by releasing the clamping means, raising or lowering the support rails to the desired height, and reaffixing the clamping means to retain the support rails in place. Of course, any type of clamping means may be used which permits raising and lowering of the support rails.

The support rails 10 must be made of a material which is sufficiently strong to restrain a patient in a state of muscle spasms from rolling off the table, as well as to permit a patient to use armstrength alone to maneuver the body along the table. In the case of a paraplegic patient who has no significant limitation of function of the arms, the patient can grasp the support rails and move up and down the examination table at will. Accordingly, these support rails must be strong enough to support the stress applied when a patient moves along the table in this manner. The support rails can be made of any type of material that will withstand the types of stresses placed thereupon. One type of material that can be used for these support rails is steel tubing of approximately 2 inches in diameter. One skilled in the art can readily identify many different materials which possess the strength required for such rails.

Two types of stirrups are provided on the table, and each type of stirrup can be retracted and moved sideways to accommodate any type of lower limb configuration. The boots 5, are specifically provided for patients whose limbs are not of conventional length because of amputation, congenital reasons, or for patients whose skin may be sensitive to pressure, such as from ulcers or burns. The boots 5 are supported by a rod means such as a rod 7 which is attached to the table top 2 beneath the pad 14 for the patient by a clamp 8. This clamp is designed to permit rod 7 to be moved in any direction, for example, sideways to accommodate patients whose legs are locked into position, or to provide maximum comfort to a patient whose legs are very short, as well as to permit the rod to be moved vertically. Lever 6 locks the boot 5 into position once the patient's foot or stump has been inserted therein. The particular type of clamping means used for the rod 7 is not critical. However, whatever type of clamping means is used it must enable the support means to be moved up and down, and sideways or through a 360° angle so that the patient's legs may be retained in an infinite number of positions.

The boots are made of a material which is sufficiently strong and rigid to support a limb comfortably, such as molded plastic. For maximum comfort, the boots are lined with a soft lining such as quilted fabric of cotton or polyester. Alternatively, the boots can be lined with fleece, foamed synthetic or natural rubber or other soft material. The boot provides support over a substantial portion of the patient's limb, thereby avoiding pressure points and constrictions, and the lining further enhances the even spreading of pressure over the entire supported surface. The boots can be of any length, but the boots preferably are sufficiently long to cradle the leg up to the knee. Ideally, the boot should provide support for a leg from toe to calf.

Figure 3:
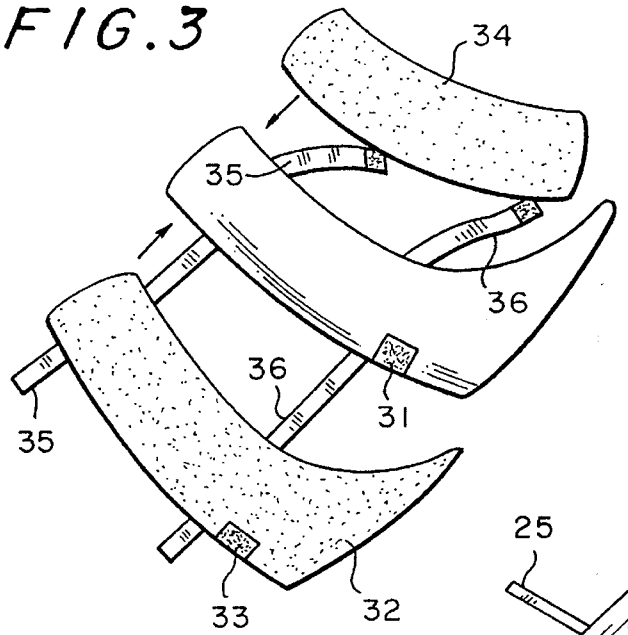
FIG. 3 shows a boot-like stirrup for use on the examination table.

In a preferred embodiment of the invention, the boot-like stirrup 30, shown in FIG. 3, comprises a shell made of a rigid material such as molded plastic in order to support the limb of a patient and to distribute the points of contact with the boot over as large an area as possible. The shell includes a rest portion to support the bottom of the foot and a second portion that supports the rear part of the leg. A removable liner 32 is made of a soft, foamed material covered with a smooth, waterproof plastic cover which is easily wiped clean. This liner conforms to the inner portion of the boot which supports the patient's leg and foot. Fastening means, such as a piece of VELCRO® hook and loop type filamentary engaging fastener 33 is attached to the back of the liner, which mates with a mating fastening means, such as a corresponding piece of VELCRO® hook and loop type filamentary engaging fastener 31 on the interior of the boot preferably in the second portion of the boot, to retain the liner in place. For maximum comfort, a top liner 34 is placed onto the top of the patient's foot or leg. Adjustable straps 35, 36 are provided to secure the boot onto the patient's leg. These straps can be secured around the patient's leg and foot by any suitable securing means, such as buckles, ties, or VELCRO® hook and loop type filamentary engaging fasteners.

The bottom and top liners or first and second cushioning means are particularly useful for patients who suffer from muscle spasms, which can involuntarily cause the legs to jerk or twist while in the boots. Each cushioning means distributes the pressure from the boot over as large an area as possible, and thus prevents the skin from breaking when the leg is jerked or twisted against the restraint.

Conventional stirrups 9 can be retracted when the boots 5 are in use. When the conventional stirrups 9 are in use, the boots 5 can be retracted by adjusting lever 6 and moving the boots out of the way. Alternatively, the rod 7 can be hinged to permit moving the boots out of the way. Preferably the conventional stirrups are attached to the table in such fashion that they can be moved both horizontally and vertically. Examples of types of stirrups and means of attachment with can be used are shown in U.S. Pat. Nos. 548,024; 2,804,363; 3,452,978; and 3,944,205, the entire contents of which are hereby incorporated by reference.

An electrical outlet 12 is provided for ease in connecting electrically powered instruments for use on the patient. This outlet can be positioned at any location on the table which does not interfere with the physician's examination of the patient.

A backrest control 13, which may be manually or pneumatically operated, is placed near the head of the table in order to adjust the height and angle of the portion of the table bearing the patient's head and upper back.

A stainless steel pan 15 is provided near or at the foot of the table.

An armboard 23 on either side of the examination table provides support for a patient's arm while the patient is receiving intravenous fluid or when any treatment is applied to the arm, such as implanting slow-release contraceptives. Straps 25 are provided on the armboard to encircle the patient's arm and retain it in place on the armboard. The armboard is connected to the examination table in much the same way as the boot stirrups. The arm board is supported by a rod which is attached to the table beneath the pad 14 by a clamp. This clamp permits the rod to be moved sideways to accommodate patients whose arms may be locked into position, or to provide maximum comfort to a patient whose arms are very short. A lever locks the armboard into position once the patient's arm has been placed on the armboard. Removable first and second cushioning means similar to those provided for the boot stirrups may be provided for additional protection for patients' skin. Examples of armboards which can be used in the present invention, as well as means to attach these armboards to the table, are shown in U.S. Pat. Nos. 3,289,674; 2,605,152; 3,227,440; and 4,698,837, the entire contents of which are hereby incorporated by reference.

Particularly for use with patients having burned skin, cushioned removable liners similar to the liners for the boots are provided for the armboards. Both upper and lower liners may be provided so that the patient's arm is surrounded by cushioning while positioned in the armboard.

Figure 4:
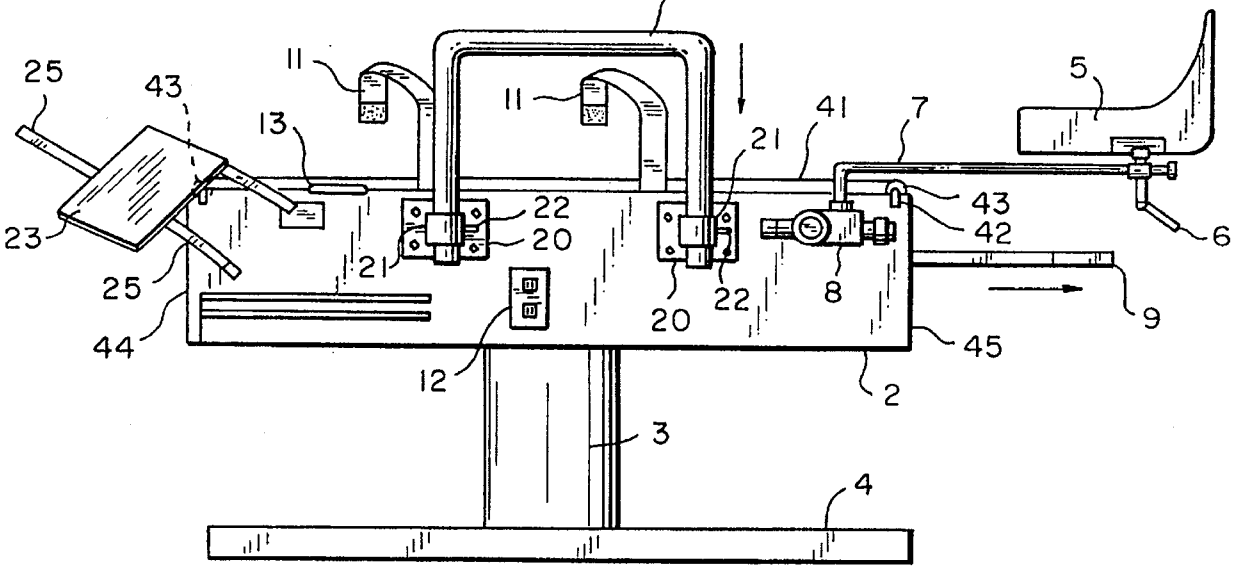
FIG. 4 shows a side view of the examination table equipped with a conveyor belt.

FIG. 4 shows the examination table 1 equipped with a conveyor belt 41 traversing the patient support lengthwise which is used to move a relatively immobile patient from a wheelchair or other conveyance onto the table and down the table to the proper position for the medical procedure to be performed. The patient is placed onto the conveyor belt at the head of the table 44 and the conveyor belt readily moves the patient lengthwise across the patient support in the direction of the foot of the table 45. The patient may be moved as far as desired by controlling the amount of motion imparted to the conveyor belt, so that the patient is properly positioned for medical procedures to be conducted on the patient. Of particular importance is moving the patient from the head of the table down so that the patient's feet or lower limbs can be inserted into the stirrups or boots.

The conveyor belt is driven by a conventional motor (not shown) and is connected to the table by pins 43 which are attached to the table sides by fasteners 42. The pins 43 move the belt over the pins in a motion that is from the head of the table 44 to the foot of the table 45.

The table of the present invention thus provides ease in moving a handicapped patient onto the table, as well as many different ways of ensuring the safety and comfort of the patient. The head can be raised or lowered, and the patient' head and upper body can be strapped down to the table where appropriate. Strong side bars keep the patient on the table when there is a danger that the patient may slide or roll off of the table, as well as provide support for a patient to move when using the arms. Two types of stirrups are provided; conventional stirrups can be moved into any direction to accommodate patients whose legs may move or be locked in different directions from the attitude of conventionally attached stirrups. For patients who require additional leg or foot support or who require support distributed over a large area, stirrups fitted with boots can be used to provide this support. The boots are sufficiently long to provide support at least up to the kneed and preferably up part of the thigh. Armboards provide support and control for the arms during treatment.

The foregoing description of the specific embodiments reveal the general nature of the invention so that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A stirrup for supporting a patient's limb comprising:

a rigid shell comprising a complete unit having a first portion to support the bottom of the foot and a second portion that supports the rear part of the leg;

a plurality of adjustable straps attached to said shell to retain said limb in said shell;

a first liner which conforms to the inner surface of said shell, and a second liner which covers the top of the patient's limb when the limb is in the shell.

2. The stirrup according to claim 1, wherein fastening means is provided on the inner surface of said shell and mating means for said fastening means is provided in the back of said first liner.

3. The stirrup according to claim 2 wherein said fastening means and said mating means comprise interlocking pieces of hook and loop fasteners.

4. An examination table comprising:

a base, a telescoping pole attached to the base, and a patient support on top of said telescoping pole whereby said patient support can be moved upwardly or downward;

said patient support having a head end, a foot end, and two sides;

attached near the foot of said patient support is a first pair of stirrups, wherein each stirrup comprises a support means which supports a boot to receive the lower end of a patient's leg;

said support means being attached to said patient support by a clamping means in such fashion that said support means can be moved both vertically and horizontally;

wherein said boots are open and are provided with straps to close said boots and said boots are provided with a removable first cushioning means which lines the inside of said boots;

and said boots are provided with a removable second cushioning means which covers a patient's foot while in said boots;

whereby said telescoping pole can be lowered so that the top surface of said patient support is at the level of the seat of a wheelchair.

5. An examination table comprising:

a base, a telescoping pole attached to the base, and a patient support on top of said telescoping pole whereby said patient support can be moved upwardly or downward;

said patient support having a head end, a foot end, and two sides;

attached near the foot of said patient support is a first pair of stirrups and a second pair of stirrups, wherein each stirrup comprises a support means which supports a boot to receive the lower end of a patient's leg;

said support means being attached to said patient support by a clamping means in such fashion that said support means can be moved both vertically and horizontally;

whereby said telescoping pole can be lowered so that the top surface of said patient support is at the level of the seat of a wheelchair.

6. An examination table comprising:

a base, a telescoping pole attached to the base, and a patient support on top of said telescoping pole whereby said patient support can be moved upwardly or downward;

said patient support having a head end, a foot end, and two sides;

attached near the foot of said patient support is a first pair of stirrups, wherein each stirrup comprises a support means to receive the lower end of a patient's leg;

said support means being attached to said patient support by a clamping means in such fashion that said support means can be moved both vertically and horizontally;

a second pair of stirrups; and means to secure a patient on the examination table;

whereby said telescoping pole can be lowered so that the top surface of said patient support is at the level of the seat of a wheelchair.

7. The examination table according to claim 6 further including at least one arm board.

8. The examination table according to claim 6 wherein said support means support a boot to receive the lower end of a patient's leg.

9. The examination table according to claim 6 wherein the means to secure a patient on the examination table is a guard rail.

10. The examination table according to claim 6 wherein the means to secure a patient on the examination table is at least one strap.

* * * * *